US005429681A

United States Patent [19]

Mesenbring

[11] Patent Number: 5,429,681

[45] Date of Patent: Jul. 4, 1995

[54] ELECTRONIC CONDIMENT DISPENSING APPARATUS

[75] Inventor: John M. Mesenbring, Glendale, Calif.

[73] Assignee: Condiment Master, Inc., Los Angeles, Calif.

[21] Appl. No.: 101,213

[22] Filed: Aug. 4, 1993

Related U.S. Application Data

[63] Continuation-in-part of Ser. No. 960,057, Oct. 14, 1992, abandoned.

[51] Int. Cl.[6] ..... B05C 13/02

[52] U.S. Cl. ..... 118/696; 118/16; 118/24; 118/315; 417/383; 417/395; 417/396; 417/397; 417/404; 222/132; 222/135; 222/249; 222/325

[58] Field of Search ..... 222/132, 135, 145, 144.5, 222/249, 330, 334, 325; 417/383, 395, 396, 397, 404; 118/16, 24, 25, 696, 315

[56] References Cited

U.S. PATENT DOCUMENTS

| | | | |
|---|---|---|---|
| 1,741,731 | 12/1929 | Nordensson | 417/396 |
| 3,127,057 | 3/1964 | Belshaw | 222/1 |
| 3,216,627 | 11/1965 | Best et al. | 222/249 |
| 3,311,271 | 3/1967 | Middleton | 222/330 |
| 3,601,285 | 8/1971 | Leger | 222/66 |
| 3,648,596 | 3/1972 | Zito | 118/24 |
| 3,727,844 | 4/1973 | Bencic | 239/414 |
| 3,913,792 | 10/1975 | Brill et al. | 222/144.5 |
| 4,143,688 | 3/1979 | Gill, Jr. et al. | 141/104 |
| 4,266,726 | 5/1981 | Brown et al. | 239/406 |
| 4,356,935 | 11/1982 | Kamin | 222/1 |
| 4,372,354 | 2/1983 | Moore | 141/361 |
| 4,386,888 | 6/1983 | Verley | 417/393 |
| 4,477,003 | 10/1984 | Baker et al. | 222/642 |
| 4,761,118 | 8/1988 | Zanarini | 417/254 |
| 4,878,601 | 11/1989 | Flemming et al. | 222/137 |
| 5,027,284 | 6/1991 | Senghaas et al. | 364/479 |
| 5,029,100 | 7/1991 | Young et al. | 364/479 |
| 5,031,567 | 7/1991 | Daouse et al. | 118/5 |
| 5,102,015 | 4/1992 | Barnard et al. | 222/135 |
| 5,121,855 | 6/1992 | Credle, Jr. | 222/129.2 |

FOREIGN PATENT DOCUMENTS

| | | |
|---|---|---|
| 0253406A3 | 7/1987 | European Pat. Off. . |
| 0303861 | 2/1989 | European Pat. Off. . |
| 0461744A1 | 3/1991 | European Pat. Off. . |
| 0116024 | 12/1900 | Germany . |
| 1272467 | 4/1972 | United Kingdom . |

*Primary Examiner*—Timothy M. McMahon
*Assistant Examiner*—N. Bhat
*Attorney, Agent, or Firm*—Fulbright & Jaworski

[57] ABSTRACT

An electronic condiment dispenser may dispense a plurality of condiments. The condiment dispenser may include a bag support module for holding a plurality of condiment supply bags. A pump regulator module may be connected to each condiment bag and may pump a condiment from the bag to a manifold diffuser module. The pump regulator module may include a multi-chambered pump having separate chambers for isolating the pump working fluid from the condiment, so the pump working fluid does not contaminate or react with the condiment. A main case may house at least one manifold diffuser module and may be configured to support a tray carrying a large number of food targets, i.e., 6 or 12 food targets, such as hamburger buns or taco shells. A programmable control module may be connected to the pump regulator module for controlling and selectively dispensing a predetermined amount of condiment and/or number of condiments to a predetermined number of food targets. The condiment dispenser is configured in modules to enhance the reliability of the dispenser, while facilitating the cleaning of the dispenser.

40 Claims, 10 Drawing Sheets

ELECTRONIC CONDIMENT DISPENSING APPARATUS

CROSS-REFERENCE TO RELATED APPLICATIONS

This is a Continuation-In-Part of U.S. patent application Ser. No. 07/960,057, filed Oct. 14, 1992, now abandoned.

BACKGROUND OF INVENTION

1. Field of the Invention

The invention relates to a condiment dispensing apparatus, and more particularly, to an electronic condiment dispenser with a multi-chambered pump for isolating a pumped condiment from the pump working fluid.

2. Description of the Related Technology

Traditional condiment dispensers and methods for dispensing condiments are time consuming, costly and yield inconsistent amounts of condiments dispensed, when applied to large scale operations, such as fast food restaurants. Condiments such as prepared sauces and spreads including mustard, mayonnaise, ketchup, barbecue,sauce are utilized to enhance the flavor of foods such as hamburgers, hot dogs, sandwiches and salads.

Commercial high-volume food preparation enterprises such as fast food restaurants, convenience stores, lunch counters and refreshment stands at sporting events and concerts frequently dispense large quantities of condiments in individual servings during daily operations. These high-volume commercial enterprises encounter difficulties when dispensing condiments in a traditional fashion, i.e., from with squeeze bottles, pump dispensers, a vat and knife, or bulk containers.

Squeeze bottles and pump dispensers are time consuming to use as the dispenser must be actuated each time a food article is being prepared. Pump dispensers offer the advantage of consistency between the amount of condiment dispensed, but may be of limited capacity. Squeeze bottles are disadvantageous as the portions are frequently dispensed in inconsistent amounts and are typically hand held and are of limited capacity.

The vat and knife offer inconsistent amounts of the servings, and the condiment may easily overflow from the vat onto the food receiving the condiment or soil the preparation area. An open vat may easily become contaminated with foreign particles. The vat may allow oxidation of the condiment and negatively affect the flavor of the condiment.

The above-stated condiment dispensers are reusable by refilling the dispenser, thereby increasing the risk of condiment contamination or reaction with the atmosphere or any working fluid used in the dispenser.

U.S. Pat. No. 4,143,688 discloses an apparatus for selectively dispensing pasty substances such as mustard and/or catsup. The apparatus is configured to dispense the mustard and catsup to a dozen or a half dozen buns. A solenoid reciprocates a valve spool for controlling the flow of compressed air to manifolds. The apparatus is disadvantageous as there is no provision for metering or consistently dispensing a predetermined amount of condiment. Further, the working fluid, i.e., compressed air, acts directly on the condiment and may adversely affect the flavor of the dispensed condiment. The working fluid may also contaminate the condiment with the impurities in the working fluid, thus leading to sanitation issues. Further, the ability to easily clean the above referenced device to meet national and international sanitation specifications for fast food chains and restaurants (National Sanitation Foundation (NSF) approval) is questionable. By not meeting NSF requirements the ability to market a food device may be nearly impossible.

U.S. Pat. No. 4,477,003 discloses a condiment dispensing system for applying condiments such as ketchup, mustard, relish and the like. Each of a plurality of guns may be used to dispense a different condiment from a pump assembly. The gun may include a metering chamber for dispensing a predetermined amount of condiment. The amount of condiment dispensed may be varied by selecting spacer members of different lengths. This dispenser is disadvantageous, as approximately one or two food articles may be prepared at a time by the food preparer using hand-held dispenser guns. Further, the ability to easily clean the above referenced device to meet national and international sanitation specifications for fast food chains and restaurants (National Sanitation Foundation (NSF) approval) is questionable. Further, the time to operate the above system is relatively slow, i.e., about 4 seconds or more per chamber load.

There exists a need for a condiment dispenser that permits a food operator to quickly dispense predetermined amounts of a plurality of condiments to large numbers of food articles in a short period of time. There further exists a need for a condiment dispenser that isolates the condiment from the working fluid used to convey the condiment.

SUMMARY OF THE INVENTION

It is an object of the invention to provide a condiment dispensing apparatus with a dosing and control element (portion control) for consistently dispensing a predetermined amount of condiment.

It is also an object of the invention to provide a condiment dispensing apparatus with a multi-chambered pump for isolating a working fluid of the pump from a condiment to be dispensed.

It is a further object of the invention to a condiment dispensing apparatus that permits a single user to quickly apply condiments to a number of food targets in a single operation.

It is a further object of the invention to provide a sanitary system that is completely closed from the condiment supply bag to the dispense nozzle.

It is a further object of the invention to provide a system that may be easily cleaned with as little waste of condiment product as possible and meet NSF (National Sanitation Foundation) approval.

According to the invention, an electronic condiment dispenser may dispense a plurality of condiments. The condiment dispenser may include a bag support module for holding a plurality of condiment supply bags. A pump regulator module may be connected to each condiment bag and may pump a condiment to a manifold diffuser module (MDM). The pump regulator module may include a multi-chambered pump having separate chambers for the pump working fluid and the condiment. The pump working fluid is isolated so it cannot or does not contaminate or react with the condiment. From the condiment bag to the outlet diffuser on the MDM the system is completely closed thus providing a pure tasting, non-contaminated—sanitary condiment dispensing system.

A main case may house at least one manifold diffuser module (MDM) and may be configured to support a tray carrying a large number of food targets, i.e., 6 or 12 food targets, such as hamburger buns or taco shells. A programmable control module may be connected to the pump regulator module for controlling and selectively dispensing a predetermined amount of condiment and/or number of condiments to a predetermined number of food targets. According to the preferred embodiment, the condiment dispenser is configured in modules to enhance the reliability of the dispenser, while facilitating the cleaning of the dispenser.

DETAILED DESCRIPTION OF THE PREFERRED EMBODIMENT

Figure 1:
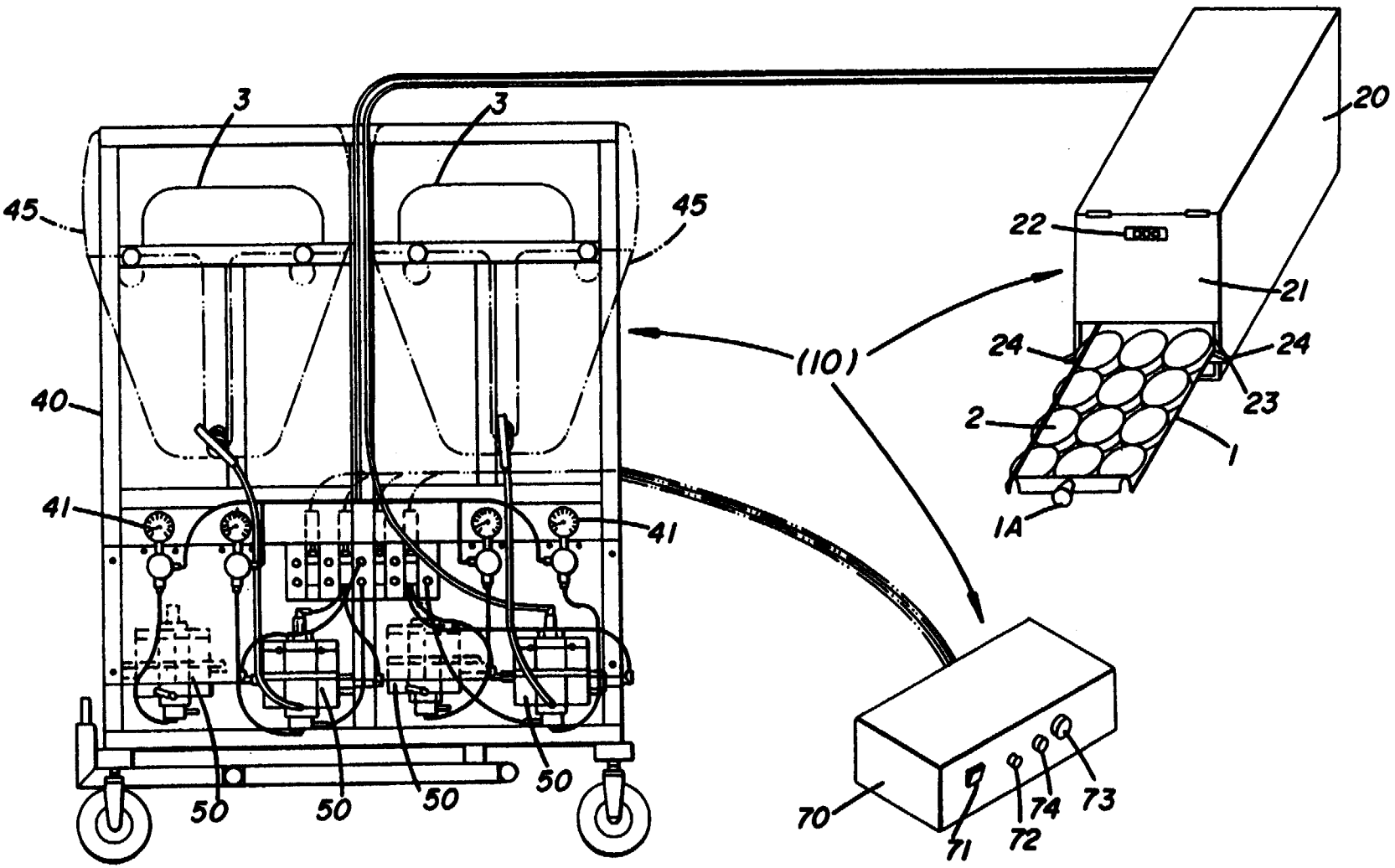
FIG. 1 shows a perspective view of a condiment dispenser according to the invention.

FIG. 1 shows an electronic condiment dispensing apparatus 10 according to the preferred embodiment. The condiment dispenser includes a main case 20, at least one manifold diffuser module 30 (see FIG. 4) located in the main case, a pump regulator module 40 and a programmable control module 70. The system features full modularity in all components. For example, the supply lines between the pump regulator module and the main case are provided with quick disconnect couplings at their respective ends. This allows the main case and manifold diffuser modules to be quickly and easily disconnected for cleaning or service. The pumps 50 and regulators 41 are also easily removable from the pump regulator module for purposes of service or placement.

Figure 3:
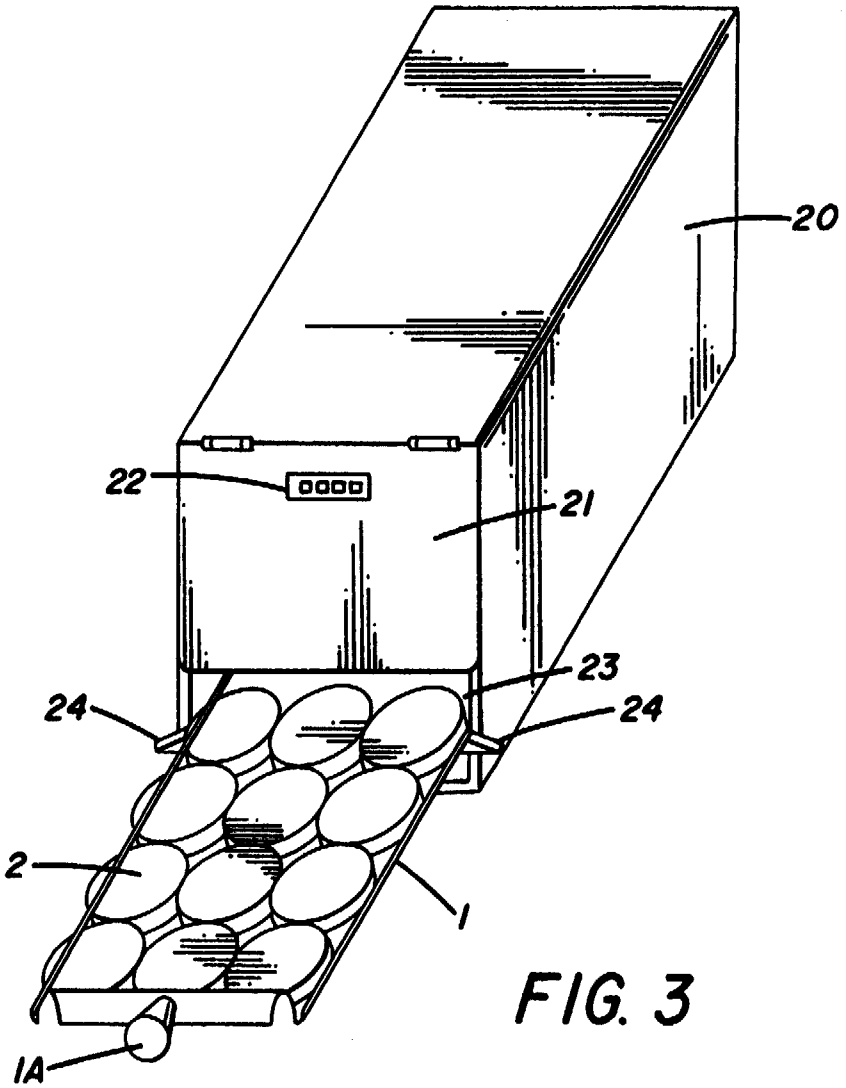
FIG. 3 shows a perspective view of the condiment dispenser main case of FIG. 2, with the hamburger tray partially removed.
Figure 2:
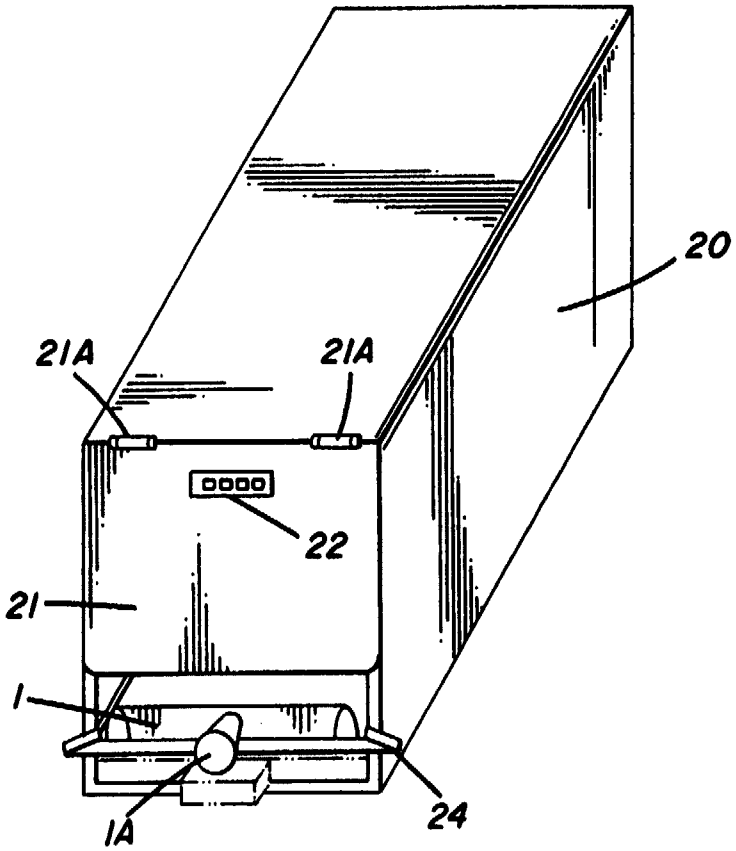
FIG. 2 shows a perspective view of a main case of a condiment dispenser according to the invention, with a hamburger tray located in the bottom portion of the main case.
Figure 4:
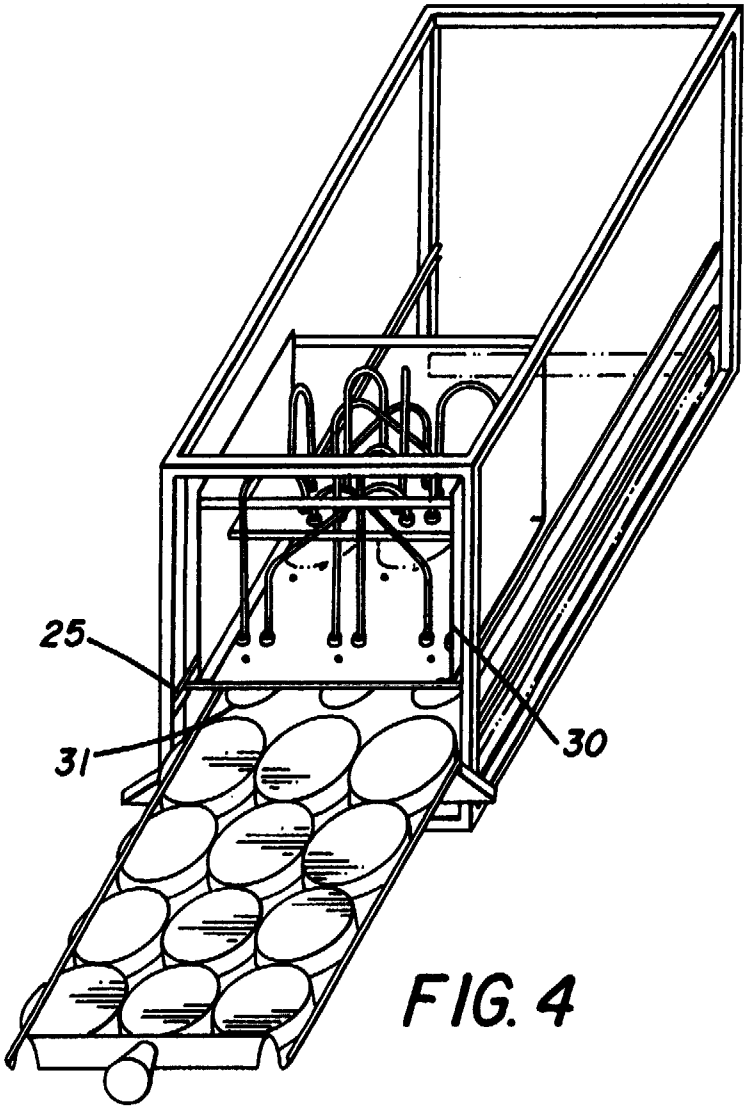
FIG. 4 shows a perspective view of the condiment dispenser main case of FIG. 2, with the hamburger tray partially removed and a pivoting hood in a raised position.

FIGS. 2–4 show main case 20, food target tray 1 and manifold diffuser module 30. Main case 20 serves as a locator and housing for the manifold diffuser module and the food target, i.e., hamburger buns, taco shells, ice cream cones and the like. Main case 20 includes a pivoting hood 21 that is pivotally connected to the main case by hinge connections **21*a*. Pivoting hood 21 may carry a waterproof key pad 22** for selecting (switching) the operation to be run on the programmable control module. A preferred embodiment of the key pad has a waterproof membrane switch button plate on its front face which allows the user to input the number of food targets to be served, i.e., 6 buns or 12 buns. The back of the key pad includes a waterproof circuit and a waterproof flex cable which connects the key pad to the programmable control module. The key pad may also be contained in a hand held case (not shown) with up to an approximately 20 foot extension cable (not shown).

The food targets may be hamburger buns 2 and are located directly below condiment output diffusers 31 of the manifold diffuser module, as described in detail below. Food target tray or hamburger tray 1 includes a handle **1*a* and carries hamburger buns 2. The main case may also include tapered tray guides 24 for guiding and supporting the tray and manifold support shoulders 25 for supporting the manifold diffuser module 30** in the main case.

Figure 6A:
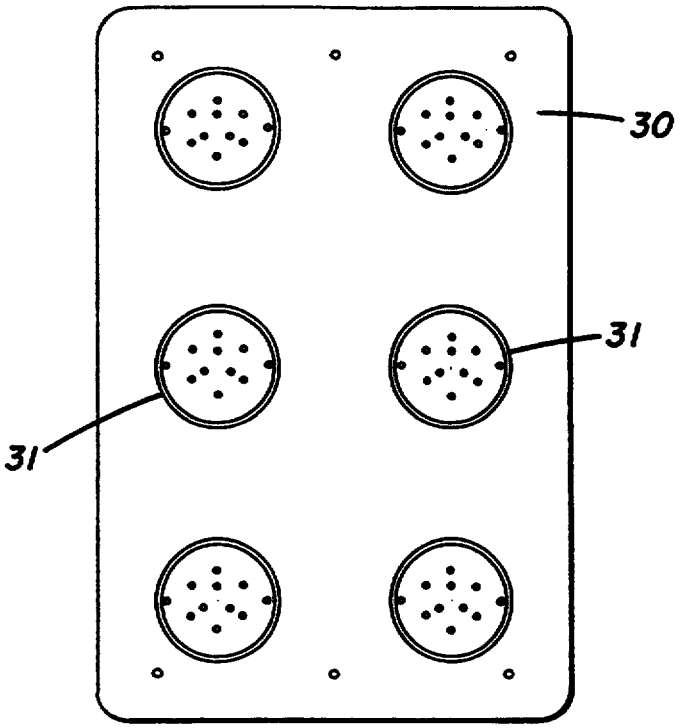
FIG. 6A shows a perspective view of condiment output diffusers located on a bottom of the manifold diffuser module of FIG. 5.
Figure 6B:
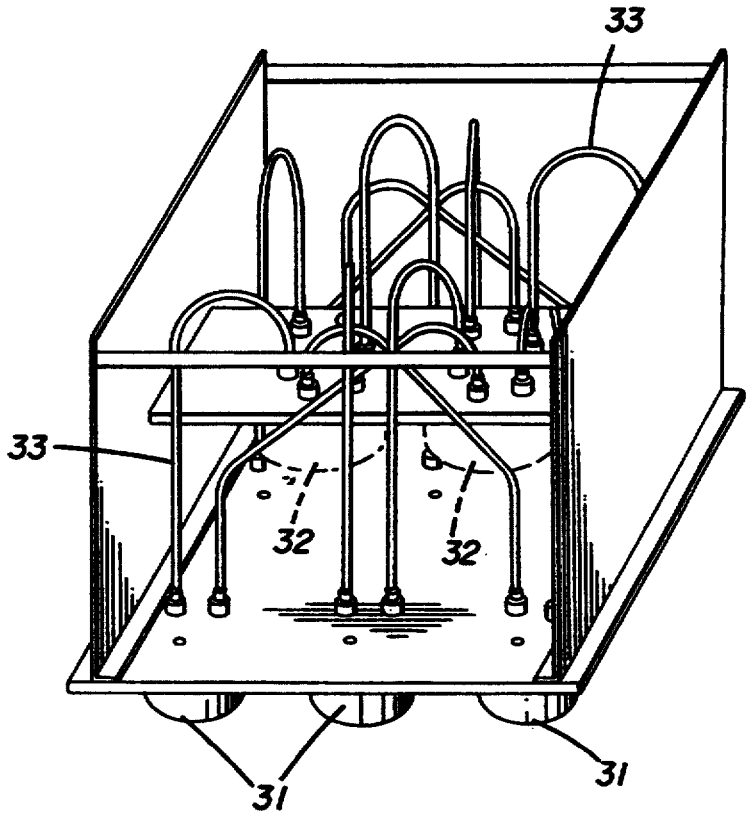
FIG. 6B shows a perspective view from a side of the manifold diffuser module of FIG. 6A.

FIG. 6A shows the bottom of MDM 30 and output diffusers 31. FIG. 6B shows MDM 30, condiment output diffusers 31, the manifold inlet for each condiment from the pump, and tubes 33 that may be connected to each output diffuser.

Figure 5:
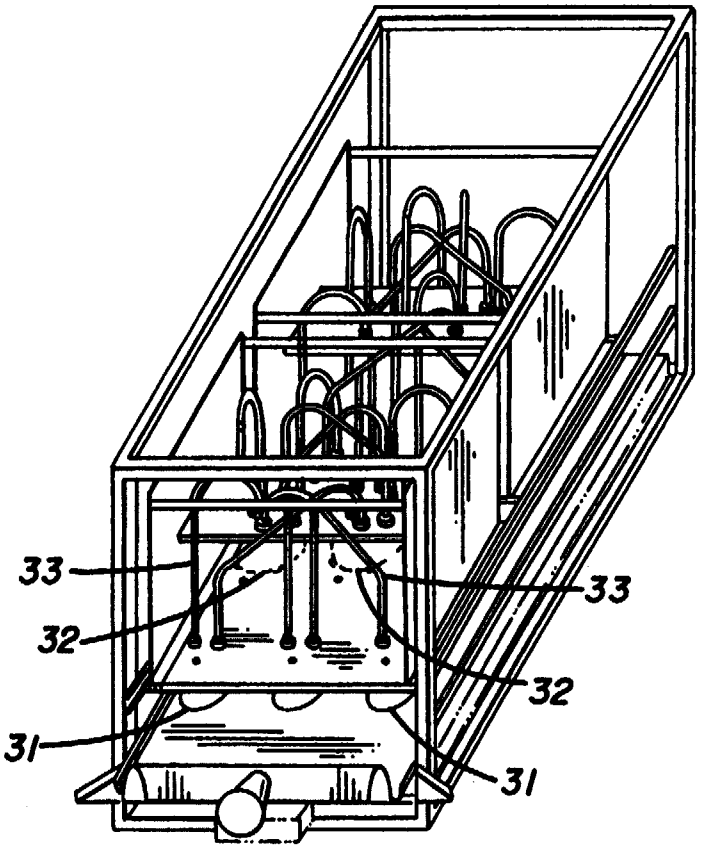
FIG. 5 shows a perspective view of the condiment dispenser main case of FIG. 2, with the main case pivoting hood in a raised position and a manifold diffuser module partially removed.

According to the preferred embodiment, as shown in FIG. 5, two manifold diffuser modules are located irk the main case. Each manifold diffuser module may be configured to include a plurality of condiment output diffusers 31, preferably six condiment output diffusers as defined by the fast food industry. Typically, in a fast food restaurant, one dozen or one half dozen burgers are made simultaneously. Thus, the spatulas, that are used, may support 6 or 12 burger buns at a time.

The manifold diffuser module, as shown in FIG. 6B, exhibits a manifold inlet 32 for each condiment. Condiment output diffusers 31 are connected to each manifold inlet 32 by tubing 33. As illustrated, the manifold diffuser module is configured for two condiments, but may be configured for more condiments. It is preferred to configure the manifold diffuser module for 2–6 condiments.

The manifold diffuser module splits and directs the flow from main manifold inlets 32 to the plurality of diffusers 31 based on the theory of flow through a pipe. In fully developed pipe flow the velocity of the fluid traveling through the pipe at a cross-section is a function of the radius. For example, by capturing a radius with equally distant holes on the same radius, i.e., six holes at 60 degrees at a one inch radius, a constant flow results through each of the six outlet holes. For condiments such as ketchup and mustard, the manifold inlet 32 splits the flow to the diffusers 31 with an accuracy of $+/-10\%$ ketchup and mustard per diffuser 31.

Figure 7:
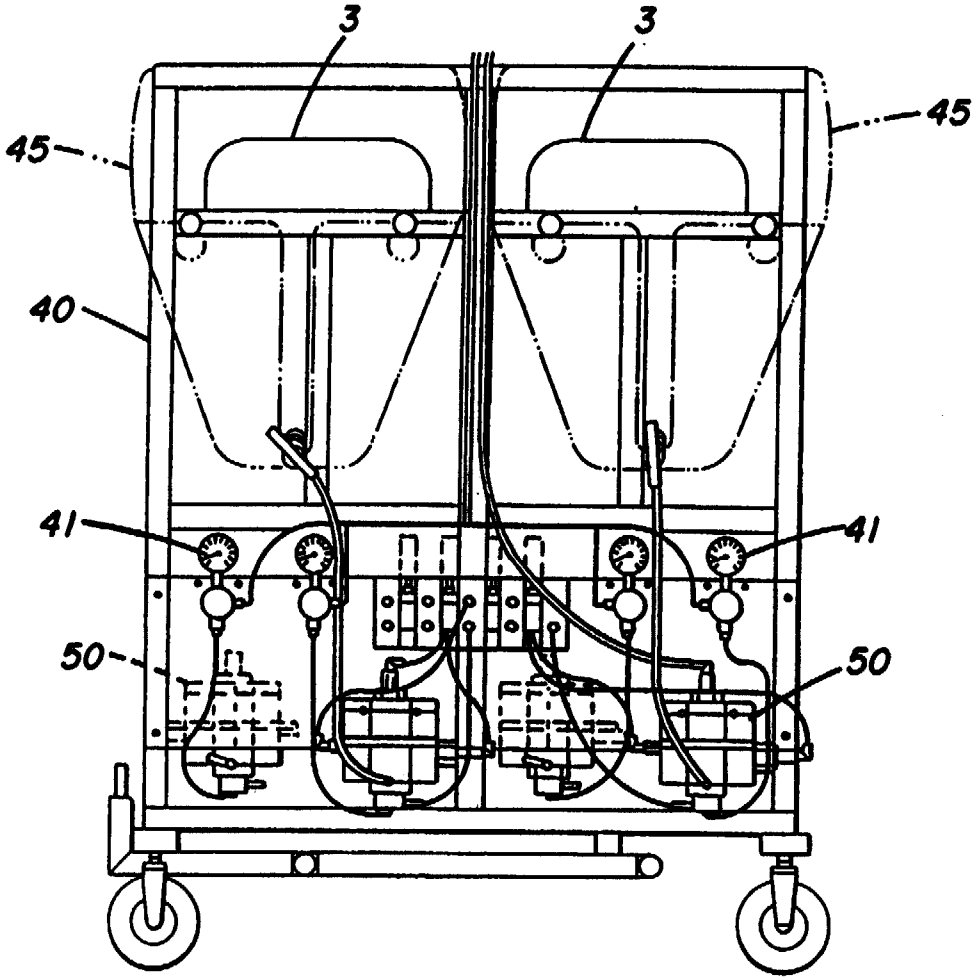
FIG. 7 shows a perspective view of a bag hanger module and pump regulator module including two pumps and pump pressure regulators.

FIG. 7 shows bag support module 45 and pump regulator module 40 are integrated on a side plate in the condiment dispenser. Preferably, condiment bags 3 are located in bag support module 45 within 20 inches of tubing supplying pumps 50 that feed the manifold inlets 32. One pump 50 is provided for each manifold inlet 32. Likewise, a pressure regulator 41 and a 4-way solenoid (see FIG. 8A) is provided to control each pump. Each pressure regulator can be adjusted by a custom lock in place snap adjustor. The snap adjustor allows the user to adjust the pressure from the air source quickly by setting the adjustor to the desired level, and snapping it in place so that the pressure setting cannot be inadvertently changed in the field. The accuracy of the pressure regulators is within 15 p.s.i. The solenoids are switched by a low voltage 24 VDC power source located within the programmable control module housing shown in FIG. 10, and are NEMA 4 rated for waterproof.

Figure 8:
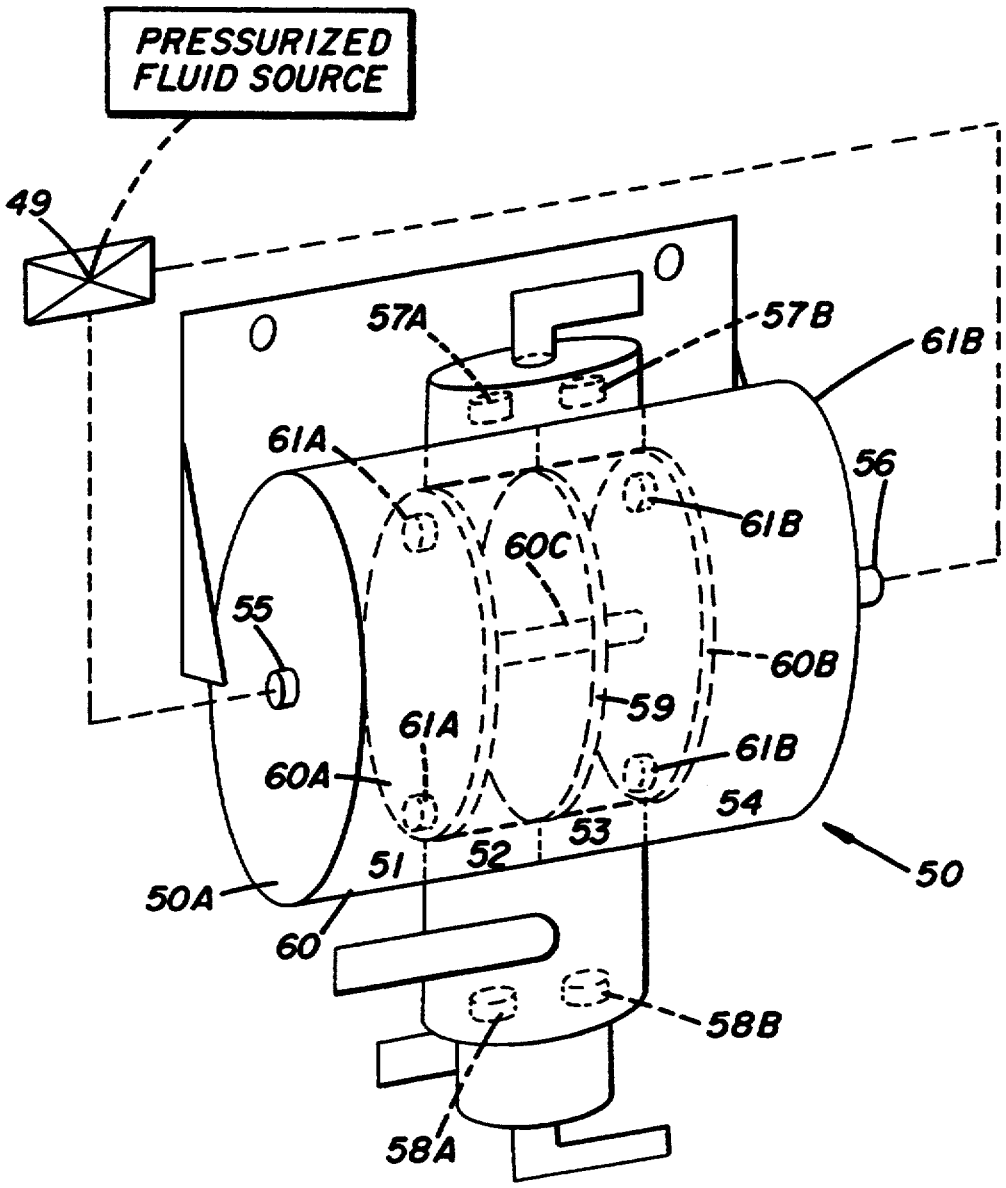
FIG. 8 shows a cross-section of a multi-chambered pump.

FIG. 8 shows a 4-way solenoid valve 49 and pump 50 of the pump regulator module. The pump operates under the force of a working pressurized fluid and may have four fluid chambers for receiving condiment and pressurized working fluid flow. A rigid piston element 60 may be mounted in the pump and may move in a reciprocating fashion.

Rigid piston element 60 may include a first rigid piston 60*a*, a second rigid piston 60*b*, which may be connected to the first piston by rigid shaft 60*c*. Pump housing section 50*a* and first rigid piston 60*a* define chamber 51 for the working fluid. Second rigid piston 60*b* cooperates with pump housing section 50*b* to define working fluid chamber 54. Rigid shaft 60*c* may be located on fixed rigid membrane 59 and may slide through the rigid membrane. Chambers 52, 53 are sealed from each other by O-ring seals (not shown) located in rigid membrane 59.

Figure 9A:
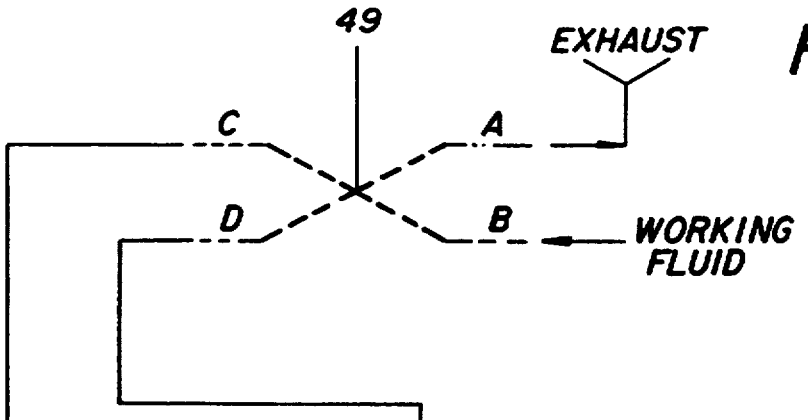
FIG. 9A shows a schematic of a 4-way solenoid valve, in the closed circuit operating position.

When solenoid valve 49 is in the "X" position, as shown in FIG. 9A, chamber 51 of pump 50 receives pressurized working fluid through opening 55 while chamber 52 pumps condiment through pump outlet 58*a*. On the other side of pump 50, chamber 54 exhausts the working fluid through opening 56 thus causing a right reciprocating motion of piston 60*a* associated with chambers 51, 52 and piston 60*b* associated with chambers 53, 54, respectively, while chamber 53 fills with condiment through inlet port 57*b*.

Figure 9B:
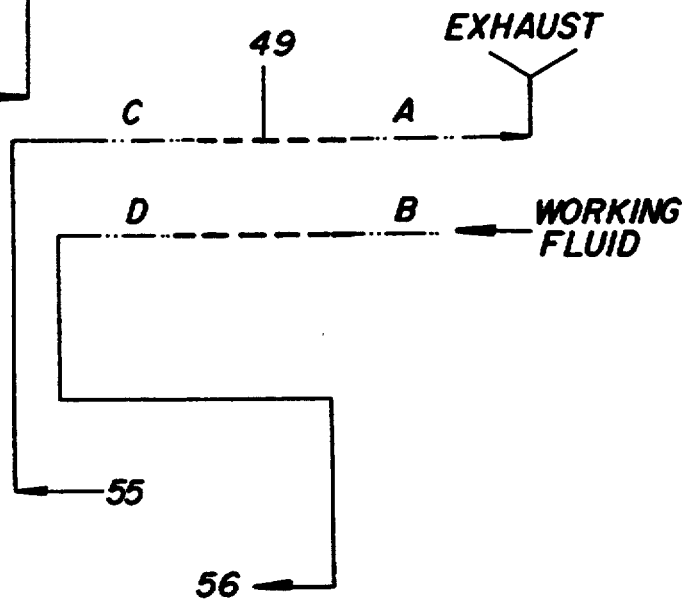
FIG. 9B shows a schematic of a 4-way solenoid valve, in the open circuit operating position.

When solenoid valve 49 is in the "=" position, as shown in FIG. 9B, chamber 51 of pump 50 exhausts pressurized working fluid through opening 55, while chamber 52 fills with condiment product through inlet valve 57*a*. On the other hand, chamber 54 receives pressurized working fluid through opening 56 thus causing a left direction motion of piston 60*a* associated with chambers 51, 52 and piston 60*b* associated With chambers 53, 54, respectively, while chamber 53 pumps out condiment through outlet port 58*b*.

The volumetric metering (dosing) effect is created by the reciprocating motion of the piston at the fastest speed that will not allow cavitation while completely filling the condiment food chambers 52, 53. This piston speed generally is a function of the temperature of the condiment and the inherent viscosity at a given temperature. By moving the piston one stroke (a leftward or rightward motion 180 degrees only) condiment chambers 52, 53 alternatively fill with condiment and discharge condiment out of the respective pump inlet and outlet ports 57, 58.

Typically both chambers 52, 53 have the same physical volume and hold condiment which is given by the inner diameter of the chambers, the solid shaft 60*c* and the total linear stroke of the pistons. However, a customer may require certain volumetric amounts thus necessitating that chamber 52 have a different physical volume than chamber 53.

As discussed above chambers 51, 52 as well as chambers 53, 54 are physically isolated from each other. Thus, the working fluid contained in chambers 51, 54 is not in contact with the condiment in chambers 52, 53 at any time. This separation of condiment from working fluid eliminates the possibility of contaminating the condiment. A non-contaminated condiment has many positive consequences as follows:

a) The condiment remains pure tasting without being taste affected by the impurities in the working fluid.
b) The condiment will not be infected by the impurities in the working fluid.
c) The condiment dispenser does not require cleaning as often because oxygen will not be introduced to the condiment fluid. Oxygen may cause oxidation and bacteria growth.
d) The ability to get NSF approval is enhanced due to the above which is required for marketability.

Other pump configurations may also prevent the working fluid from coming into contact with the condiment. These other configurations include a dual diaphragm gas driven pump, which may also be suitable.

Rigid barrier 59 divides condiment inlet 57 into two flapper valve inlets, i.e., one condiment inlet 57*a* for chamber 52 and one condiment inlet 57*b* for chamber 53. The barrier also divides condiment outlet 58 into two flapper valve outlets, i.e. one condiment outlet 58*a* for chamber 52 and one condiment outlet 58*b* for chamber 53.

Condiment inlet assembly 57 includes a valve assembly or elements 57*a*, 57*b* to allow condiment flow into chambers 52, 53, respectively, but prevents the back flow from the condiment chambers into condiment inlet 57 and prevents condiment flow between chambers 52, 53. Likewise, condiment outlet assembly 58 includes a flapper valve assembly or elements 58*a*, 58*b* for allowing condiment flow out of chambers 52, 53, respectively, but preventing back flow from condiment outlet 58 into the condiment chambers.

The type of valving used within the pumps is a function of the viscosity of the fluid being pumped, and the degree and size of the particulates present in the fluid. For example, particulant based food fluids, such as Hot Sauce and Tartar Sauce, make use of a flexible membrane flapper, ball valve or duck valve, whereas smooth fluids such as Mayonnaise make us of a flexible elastomer membrane disk pop-it type valve.

During a rightward movement of pistons 60*a*, 60*b* and shaft 60*c*, chamber 52 may discharge condiment into outlet 58 while chamber 53 may fill with condiment via inlet 57. During this movement flapper valve 57*a* is closed, valve 57*b* is open, valve 58*a* is open, and valve 58*b* is closed. Correspondingly, during a leftward movement of pistons 60*a*, 60*b* and shaft 60*c*, chamber 52 may fill with condiment through inlet 57 while chamber 53 is discharging condiment via outlet 58. During this movement flapper valve 57*a* is open, valve 57*b* is closed, valve 58*a* is closed and valve 58*b* is open.

In operation, the working fluid flows from the pressurized fluid source into one of openings 55, 56. Each of openings 55, 56 may be connected to 4-way solenoid valve 49 under the control of programmable control module 70. Rigid piston elements 60*a*, 60*b* move in the direction toward the working fluid chamber being exhausted.

When rigid piston elements 60a, 60b move toward fluid outlet 56, working fluid chamber 51 expands in size and working fluid chamber 54 contracts in size. As barrier 59 may be rigid and stationary, condiment chamber 52 contracts with condiment being discharged into outlet 58 from chamber 52. As condiment chamber 52 contracts, condiment chamber 53 expands with condiment being suctioned into chamber 53 from inlet 57.

Pump 50 may provide dosing or portion control, as the pump may be a metering pump. Pressure regulators 41 regulate the pressure of the working fluid through pump 50. The regulators may maintain the working fluid pressure at a preset pressure for a constant flow rate based on the thickest, i.e., coldest, condition of the condiment being pumped. A condiment may become thicker or more viscous as the temperature decreases.

According to the preferred embodiment, the preset pressure of the pump takes into account the ability of the pump to reliably deliver condiment at a minimum flow rate, typically 0.3 seconds per discharge. As the temperature of the condiment increases for a given regulator pressure, the speed at which the pump operates may also increase. The range of speed increase or decrease depends on properties of the particular condiment with respect to viscosity changes.

The pressure regulator of the pump may be set for a predetermined condiment minimum flow rate based on an operating temperature and viscosity range for a given condiment. A timing circuit may be connected to four-way solenoid valves and, along with the programmable control module, allow working fluid to flow into one working fluid chamber while exhausting working fluid from the other chamber. The intake and exhaust cycles of the pump are 180 degrees out of phase, i.e., when chamber 52 is discharging condiment, chamber 53 is receiving condiment.

Accordingly, a condiment portion may be metered based on the number of clock cycles delivered to the solenoid gas valves. For example, it may be desired to dispense three sizes of ketchup i.e., 0.3, 0.6 and 0.9 ounces. For a pump discharge of 0.1 ounces, three displacements dispense the first size, six displacements dispense the second size and nine displacements dispense the 0.9 ounce portion. Preferably, the clock signal frequency or speed at which the pump chambers open and close is set at a cycle time sufficient to produce the desired dispensing rate at the lowest operating temperature and thickest viscosity for the condiment.

The metering of the pump is a function of the diameter and travel of the pistons. The metering amount may be varied by adjusting the cross-sectional area and length of the stroke of the pump. The amount of condiment dispensed can be varied by placing spacers 61a, 61b within the working fluid chambers to vary the length of the stroke of the rigid piston element.

As shown in FIG. 8, spacers 61a may have a greater length than spacers 61b so more condiment is discharged from chamber 53 per stroke than the amount of condiment discharged from chamber 52. This configuration is advantageous for a customer that has requirements for certain volumetric amounts requiring chamber 52 to have a different physical volume than chamber 53. According to the invention, the varying volumetric requirements may be easily accomplished by using different sizes for spacers 61a, 61b.

Figure 10:
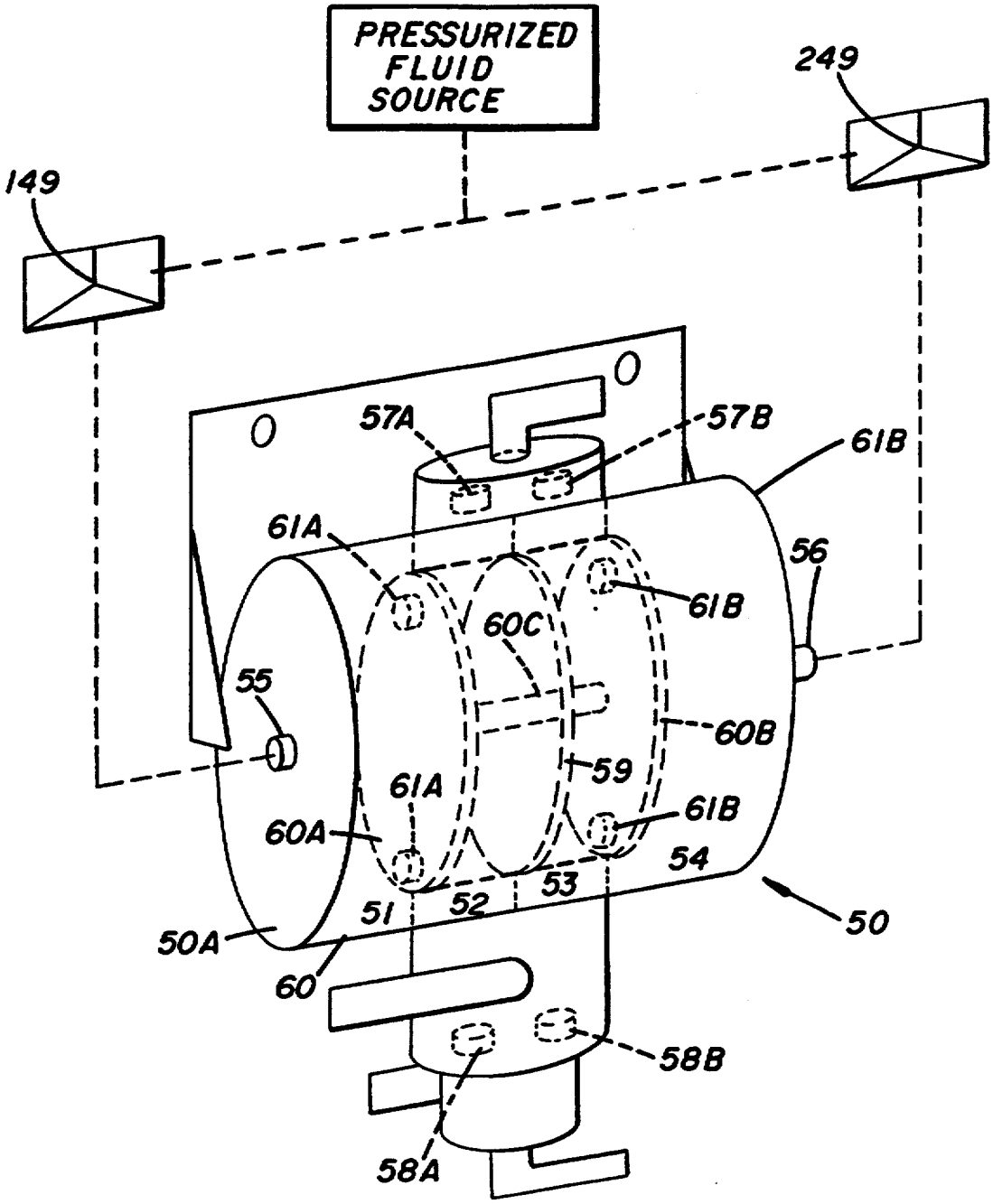
FIG. 10 shows a cross-section of multi-chambered pump according to an alternative embodiment of the invention.

FIG. 10 shows the pump regulator module of FIG. 8 according to an alternative embodiment, wherein like reference numerals indicate like components. According to this alternative embodiment, pump 50 of the pump regulator module is controlled by two 3-way solenoid valves 149, 249. Solenoid valves 149 and 249 are connected to one another so that when one valve is in the working fluid position, the other valve is in the exhaust position.

Figure 11A:
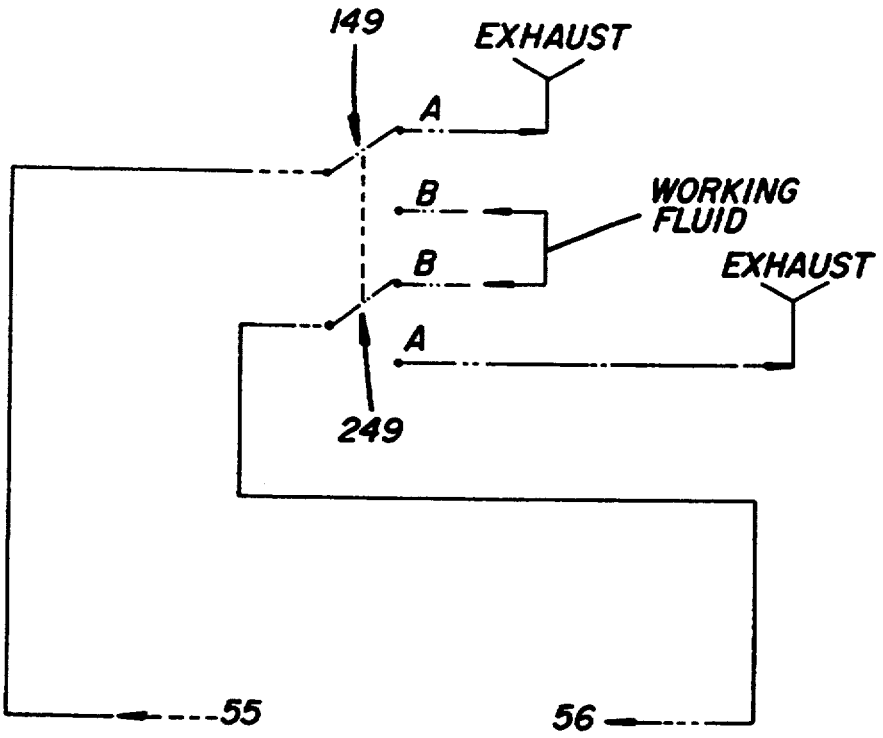
FIG. 11A shows a schematic of two 3-way solenoid valves, in a first circuit operating position.

When solenoid valve 149 is in the exhaust position, as shown in FIG. 11A, chamber 51 of pump 50 exhausts pressurized working fluid through opening 55, while chamber 52 fills with condiment product through inlet valve 57a. On the other side of the pump, solenoid valve 249 is in the working fluid position and supplies chamber 54 with pressurized working fluid through opening 56 thus causing a left direction motion of piston 60a associated with chambers 51, 52 and piston 60b associated with chambers 53, 54, respectively, while chamber 53 pumps out condiment through outlet port 58b.

Figure 11B:
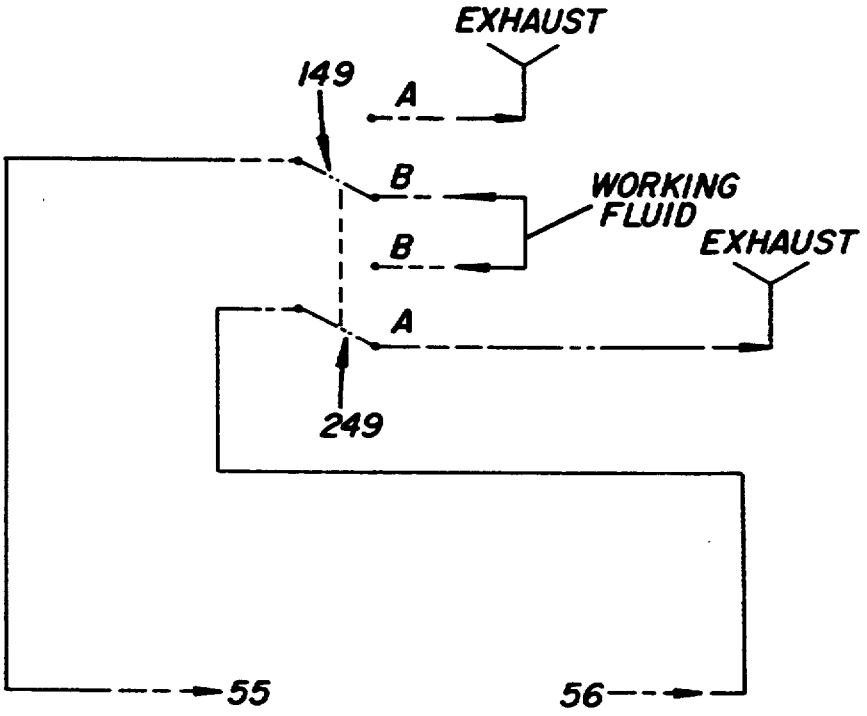
FIG. 11B shows a schematic of two 3-way solenoid valves, in a second circuit operating position.

When solenoid valve 149 is in the working fluid position, as shown in FIG. 11B, chamber 51 of pump 50 receives pressurized working fluid through opening 55 while chamber 52 pumps condiment through pump outlet 58a. On the other side of pump 50, solenoid valve 249 is in the exhaust position allowing chamber 54 to exhaust the working fluid through opening 56 thus causing a right reciprocating motion of piston 60a associated with chambers 51, 52 and piston 60b associated with chambers 53, 54, respectively, while chamber 53 fills with condiment through inlet port 57b.

Figure 12:
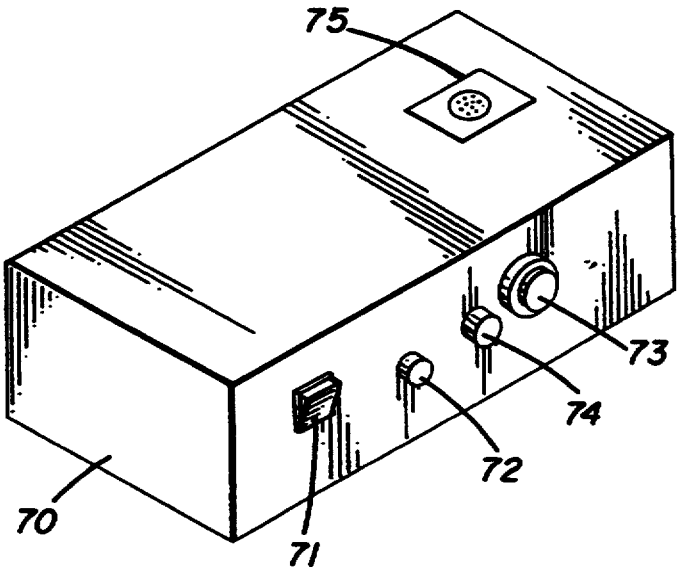
FIG. 12 shows a perspective view of a programmable control module.

FIG. 12 shows programmable control module 70 including an on/off switch 71, a lighted element 72, a loudspeaker or buzzer 73 and volume control 74. The solenoids are powered by a 24 VDC power supply contained within the programmable control module housing. Where 12 VDC solenoids are used, a 12 VDC power supply is provided. The programmable control module has an internal programmable logic controller (PLC). The PLC is fully programmable and can be easily reprogrammed in the field. A serial port interface 75 can be provided in the external casing of the programmable control module. By connecting either a hand held module or a PC based system to the unit via the serial port interface, new code, modifications to the existing code, or maintenance programs to test the system can be downloaded to the PLC.

Figure 13:
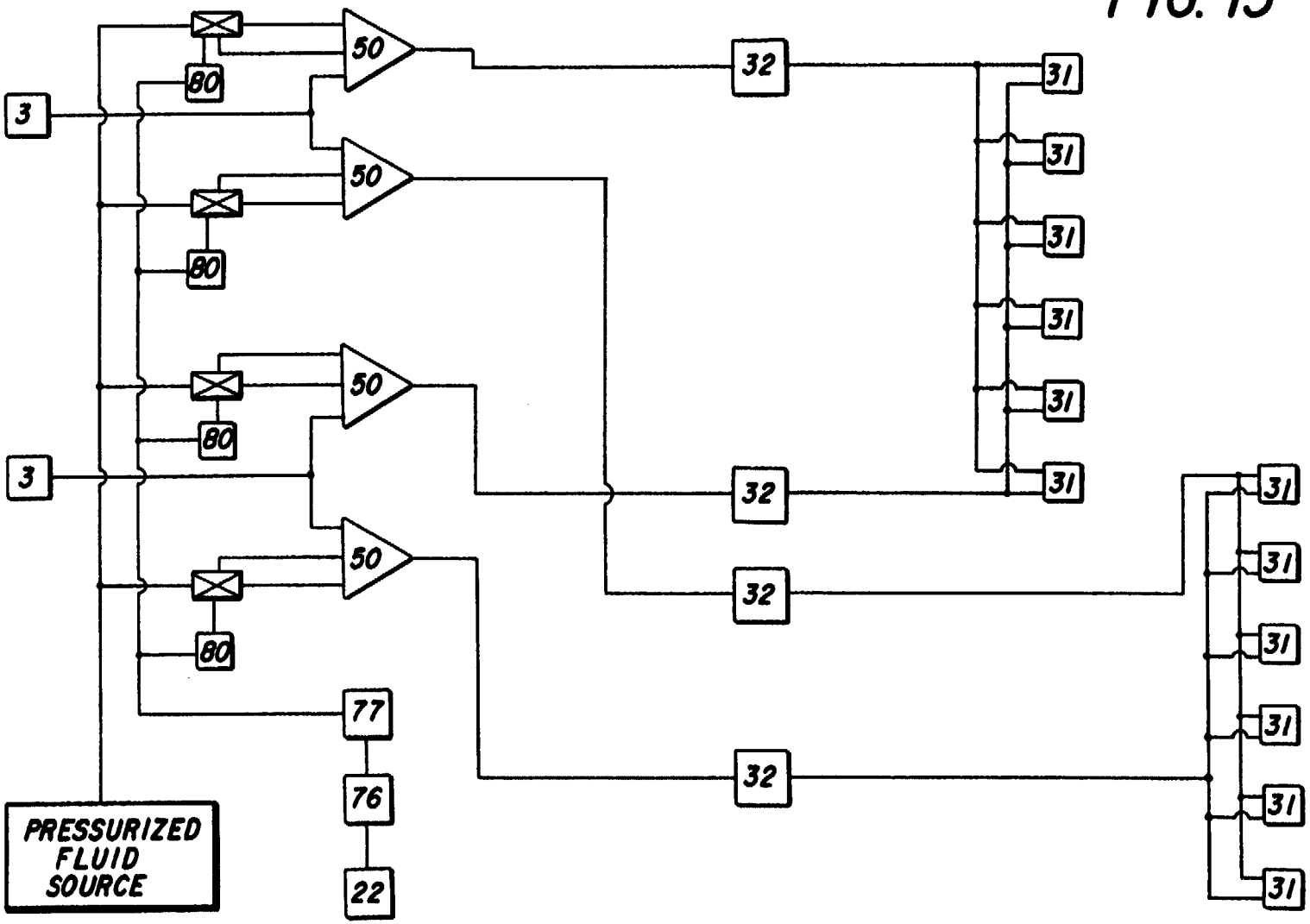
FIG. 13 shows a schematic diagram of the liquid dispensing system.

FIG. 13 shows a schematic diagram of the system according to a preferred embodiment. In operation, a user input command from the key pad 22 is received and processed by the PLC 76. The PLC determines from the user input which pumps are to be activated as well as the number of on/off low power pulses to be transmitted. The PLC then directs the power supply 77 to transmit the desired on/off low power pulses to the corresponding attached relays 80. Each activated relay in turn switches high power on/off pulses into the solenoid valves. The solenoid valve controls the amount and timing of liquid displaced by the attached pump 50. Each pump supplies liquid condiment to a manifold inlet 32. Each manifold inlet supplies liquid condiment to a plurality (6 in the preferred embodiment shown) of output diffuses 31. Each output diffuser is supplied with a plurality of different condiments, generally 2–6 condiments. In the embodiment shown in FIG. 13, two condiments are supplied to each output diffuser. Each diffuser dispenses the condiments onto a corresponding food target.

The illustrated embodiments are shown by way of example. The spirit and scope of the invention is not to be restricted by the preferred embodiment shown.

I claim:

1. A modular liquid dispensing system comprising:
at least one liquid reservoir;
at least one pump, each said at least one pump having an inlet connected to one of said at least one liquid reservoir; and
a liquid diffuser module comprising:
at least one liquid manifold diffuser connected to an outlet of a corresponding one of said at least one pump; and
a plurality of liquid output diffusers, wherein each said liquid output diffuser is connected to an outlet of each said at least one liquid manifold diffuser.

2. A modular liquid dispensing system according to claim 1, further comprising:
a plurality of said liquid diffuser modules.

3. A modular dispensing system according to claim 2, further comprising two liquid diffuser modules.

4. A modular liquid dispensing system according to claim 1, further comprising means for controlling an amount of liquid displaced and a time interval for displacement of liquid by said at least one pump.

5. A modular liquid dispensing system according to claim 4, wherein said means for controlling comprises a solenoid valve.

6. A modular liquid dispensing system according to claim 5, wherein said solenoid valve comprises two three-way solenoid valves.

7. A modular liquid dispensing system according to claim 5, wherein said solenoid valve is a four-way solenoid valve.

8. A modular liquid dispensing system according to claim 5, wherein said means for controlling further comprises a programmable control module for providing power to said solenoid valve.

9. A modular liquid dispensing system according to claim 8, wherein said programmable control module comprises:
a power supply;
an internal programmable logic controller;
a housing surrounding said power supply and said programmable logic controller.

10. A modular liquid dispensing system according to claim 9, wherein said programmable logic control module further comprises a serial port interface.

11. A modular liquid dispensing system according to claim 9, wherein said power supply is a 24 VDC power supply.

12. A modular liquid dispensing system according to claim 9, wherein the power supply is a 12 VDC power supply.

13. A modular liquid dispensing system according to claim 8, wherein said means for controlling further comprises a relay interposed between the programmable control module and the solenoid valve; said relay functioning to switch an on/off power pulse to the solenoid valve.

14. A modular liquid dispensing system according to claim 9, wherein said programmable control module further comprises indicating means.

15. A modular liquid dispensing system according to claim 14, wherein said indicating means comprises a lighted element.

16. A modular liquid dispensing system according to claim 14, wherein said indicating means comprises buzzer or loudspeaker.

17. A modular liquid dispensing system according to claim 15, wherein said indicating means further comprises a buzzer or loudspeaker.

18. A modular liquid dispensing system according to claim 16, wherein said indicating means further comprises a lighted element.

19. A modular liquid dispensing system according to claim 1, further comprising a drive fluid source and wherein said pump is a fluid driven pump.

20. A modular liquid dispensing system according to claim 19, wherein said fluid driven pump isolates a drive fluid from a pumped liquid.

21. A modular liquid dispensing system according to claim 20, wherein said fluid driven pump is a multi-chamber pump.

22. A modular liquid dispensing system according to claim 21, wherein said fluid driven pump comprises at least two drive fluid chambers separated by a pumped liquid chamber.

23. A modular liquid dispensing system according to claim 22, wherein said fluid driven pump is a diaphragm pump.

24. A modular liquid dispensing system according to claim 22, wherein said fluid driven pump is a piston bellows pump.

25. A modular liquid dispensing system according to claim 22, wherein said pumped liquid chamber comprises a first cell and a second cell, said first cell being separated from said second cell by a barrier element.

26. A modular liquid dispensing system according to claim 22, further comprising a four-way solenoid valve connected between said drive fluid source and said fluid driven pump, wherein a first input port of said valve is connected to said fluid source, a second port of said valve is a vent, a third output port of said valve is connected to a first of said at least two drive fluid chambers and a fourth port of said valve is connected to a second of said at least two drive chambers.

27. A modular liquid dispensing system according to claim 22, further comprising two three-way solenoid valves connected between said drive fluid source and said fluid driven pump, wherein each said valve comprises:
a first input port connected to said fluid source;
a second port connected to a vent; and
a third output port connected to one of said at least two drive fluid chambers.

28. A modular liquid dispensing system according to claim 25, further comprising:
a fluid inlet assembly for allowing flow of a liquid into but not out of said pumped liquid chamber; and
a fluid outlet assembly for allowing flow of a liquid out of, but not into said pumped liquid chamber.

29. A modular liquid dispensing system according to claim 28, wherein said fluid inlet assembly and said fluid outlet assembly comprise a plurality of one-way valves.

30. A modular liquid dispensing system according to claim 28, wherein said fluid inlet assembly comprises:
a first one-way inlet valve for allowing flow of a liquid into but not out of said first cell of said pumped liquid chamber; and
a second one-way inlet valve for allowing flow of a liquid into but not out of said second cell of said pumped liquid chamber; and said fluid outlet assembly comprises:

a first one-way outlet valve for allowing flow out of but not into said first cell of said pumped liquid chamber; and a second one-way outlet valve for allowing flow of a liquid out of but not into said second cell of said pumped liquid chamber.

31. A modular liquid dispensing system according to claim 29, wherein said plurality of valves are ball valves.

32. A modular liquid dispensing system according to claim 29, wherein said plurality of valves are pop-it valves.

33. A modular liquid dispensing system according to claim 29, wherein said plurality of valves are flapper valves.

34. A modular liquid dispensing system according to claim 29, wherein said plurality of valves are duck bill valves.

35. A modular liquid dispensing system according to claim 1, further comprising a pressure regulator for regulating the pressure of a drive fluid in said fluid driven pump.

36. A modular liquid dispensing system according to claim 1, further comprising a main housing surrounding and enclosing said liquid diffuser module and a target object.

37. A modular liquid dispensing system according to claim 34, further comprising a pivoting hood pivotally connected to said main housing by a hinge connection.

38. A modular liquid dispensing system according to claim 34, further comprising a waterproof keypad for selecting a number of target objects to be served.

39. A modular liquid dispensing system according to claim 36, wherein said keypad comprises:

a front face comprising a waterproof membrane switch button plate;

a back consisting of a waterproof circuit; and a waterproof flex cable connecting said keypad to said programmable control module.

40. A modular liquid dispensing system according to claim 34, further comprising a tray for supporting said target objects, said tray being removably located in said housing beneath said liquid output diffusers.

* * * * *